US005911613A

United States Patent [19]

Byrum et al.

[11] Patent Number: 5,911,613

[45] Date of Patent: Jun. 15, 1999

[54] LUMINOUS GAS DISCHARGE DISPLAY

[76] Inventors: Bernard W. Byrum, 26954 Cranden Dr., Perrysburg, Ohio 43551; Tracy W. Bradford, 6926 Springbrook La., Kalamazoo, Mich. 49004

[21] Appl. No.: 09/039,801

[22] Filed: Mar. 16, 1998

[51] Int. Cl.[6] ..... H01J 9/40; H01J 9/44

[52] U.S. Cl. ..... 445/6; 445/26

[58] Field of Search ..... 445/6, 22, 44, 445/26

[56] References Cited

U.S. PATENT DOCUMENTS

| | | | |
|---|---|---|---|
| 452,514 | 5/1891 | Beck . | |
| 1,724,584 | 8/1929 | Hendry . | |
| 1,825,399 | 9/1931 | Hotchner . | |
| 1,949,963 | 3/1934 | Hotchner | 176/14 |
| 1,961,735 | 6/1934 | Braum | 40/130 |
| 2,018,874 | 10/1935 | Reitherman et al. | 177/327 |
| 2,095,291 | 10/1937 | Schneider | 40/130 |
| 2,253,441 | 8/1941 | Cauley | 176/14 |
| 2,263,164 | 11/1941 | Dailey | 250/27.5 |
| 2,290,208 | 7/1942 | Quarrie | 445/6 |
| 2,302,667 | 11/1942 | Duncan | 40/130 |
| 2,448,937 | 9/1948 | Walter | 175/125 |
| 2,621,430 | 12/1952 | Neville | 40/125 |
| 3,085,224 | 4/1963 | Becka | 340/105 |
| 3,385,490 | 5/1968 | Malmgren et al. | 226/7 |
| 3,731,227 | 5/1973 | Rosenberger et al. | 331/94.5 |
| 3,908,252 | 9/1975 | Willems | 29/25.17 |
| 4,153,861 | 5/1979 | Warner et al. | 315/355 |
| 4,395,654 | 7/1983 | Hattori et al. | 313/496 |
| 4,504,766 | 3/1985 | Kaneko | 313/634 |
| 4,584,501 | 4/1986 | Cocks et al. | 313/493 |
| 4,723,093 | 2/1988 | Nolan | 313/643 |
| 4,740,729 | 4/1988 | Chow | 313/493 |
| 4,786,841 | 11/1988 | Fohl et al. | 313/493 |
| 4,839,555 | 6/1989 | O'Mahoney | 313/634 |
| 4,871,941 | 10/1989 | Dobashi et al. | 313/485 |
| 4,887,002 | 12/1989 | Dobashi et al. | 313/607 |
| 4,887,003 | 12/1989 | Parker | 313/634 |
| 4,931,685 | 6/1990 | Dobashi et al. | 313/15 |
| 4,990,826 | 2/1991 | Cocks et al. | 313/485 |
| 5,066,257 | 11/1991 | Farner et al. | 445/26 |

*Primary Examiner*—Kenneth J. Ramsey
*Attorney, Agent, or Firm*—MacMillan, Sobanski & Todd, LLC

[57] ABSTRACT

The invention provides a means by which a gas discharge lighting display can be made of virtually any material which can withstand temperatures over 110° F. This display uses a bypass tube to isolate heat and contamination from the main channel of a gas discharge lighting display during its manufacture. The bypass tube is then removed to force the luminous discharge to pass through the main channel, providing a lighting or advertising display of high quality and reliability.

11 Claims, 3 Drawing Sheets

LUMINOUS GAS DISCHARGE DISPLAY

FIELD OF THE INVENTION

The present invention relates to a luminous gas discharge display. More particularly, the present invention relates to a luminous display such as a sign employing a gas discharge and a method of manufacture.

BACKGROUND OF THE INVENTION

Luminous signs employing a gaseous discharge and the methods for making these signs have been disclosed in several patents. In general, these signs are made by using two or three glass plates where in one or two of the plates is formed a groove or cavity corresponding to the desired display. The cavity is hermetically sealed and attached to a gas entry port incorporating a set of electrodes. In the manufacturing process the cavity is evacuated and a quantity of gas, such as neon, is introduced into the cavity through the gas entry port. The gas is then ionized by applying a voltage across the electrode set. The ionized gas, in turn, causes the display to illuminate.

Although the many known variations on luminous signs have been proven to perform satisfactorily, further improvements on luminous signs and methods of manufacture are desired.

Accordingly, it is an object of the invention to provide a highly reliable luminous gas discharge display capable of being manufactured of most any suitable material which can withstand normal operating temperatures and vacuum levels of gas discharge illumination displays. Further, it is an object of this invention to provide a means of isolating the gas discharge display itself from the high temperatures involved in forming of electrodes of the display.

A further object of the invention is to provide a gas discharge display which maintains the optical clarity and transparency of the glass plates from which it is manufactured.

Another object of the invention is to provide that the evacuation and gas filling means to be accomplished through the same holes and tubes used to house the electrodes.

In addition, it is an object of this invention to provide that the sealing of evacuation, gas filling and electrode preparations be done to the back panel only, not to both the front and back panels.

A further object of the invention is to provide a luminous gas discharge display using low temperature sealing glass or high vacuum epoxy alone to provide a hermetic seal for the display.

Yet another object of the present invention is to provide a luminous gas discharge display that is simple and economical to manufacture.

SUMMARY OF THE INVENTION

Briefly, the present invention relates to a luminous gas discharge display. The display includes two opposing hermetically sealed plates. At least one of the plates is formed of a transparent material such as glass or Alumilite Corporation Alumilite Clear plastic and the like. Moreover, at least one of the plates includes at least one channel containing an ionizable gas to define a gas discharge path. At least two of the electrodes are positioned external of the glass plates and in communication with each of the at least one channel to ionize the ionizable gas and produce a gas discharge display.

BRIEF DESCRIPTION OF THE DRAWINGS

Further features and other objects and advantages of this invention will become clear from the following detailed description made with reference to the drawings in which.

DETAILED DESCRIPTION OF THE PREFERRED EMBODIMENTS

Figure 1:
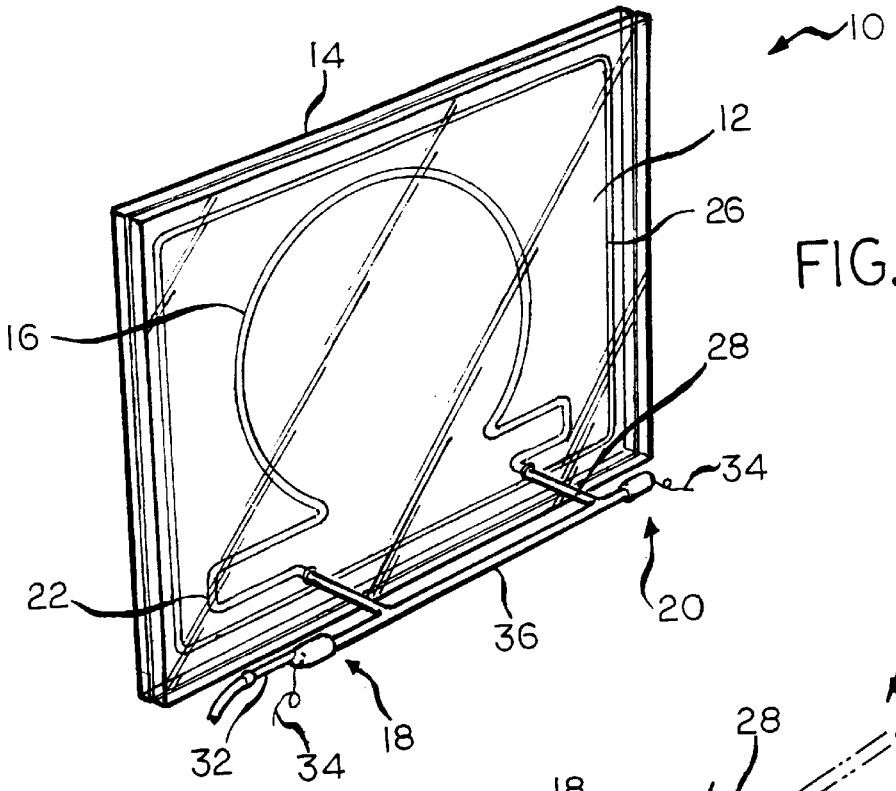
FIG. 1 is an isometric view of a luminous gas discharge display in accordance with the present invention.

Referring to the drawings, wherein like reference characters represent like elements, FIGS. 1–6 illustrate a ruminated gas discharge display 10. In considering the figures, it will be appreciated that for purposes of clarity certain details of construction are not provided in view of such details being conventional and well within the skill of the art once the invention is disclosed and explained. For example, the various components of the invention may be attached together using a low temperature frit such as Ferro Corporation glass sealing frit #7075 or Varian Corporation Torr Seal Epoxy and the like.

Referring to the figures, the luminous gas discharge display 10 includes two opposing hermetically sealed plates 12 and 14. At least one of the plates includes at least one channel 16 containing an ionizable gas and defining a gas discharge path. Positioned in communication with the at least one channel 16 are at least two electrodes 18 and 20. The electrodes 18 and 20 are located external of the two sealed plates 12 and 14. In other words, the electrodes 18 and 20 are positioned outside of the confines of the plates 12 and 14.

The plates 12 and 14 may be of most any suitable material to withstand temperatures and vacuum levels of gas discharge, in excess of about 38° C., and of most any suitable thickness and size. At least the front plate 12 of the display 10 is formed of a transparent material such as glass or plastic and the like. The glass plate may be formed of soda glass which contains at least 10 percent soda by weight. In a preferred embodiment, both the front plate 12 and the back plate 14 are formed of glass and may be the same or of a different thickness. For example, the thickness of the glass plates 12 and 14 may be less than 0.04 inches.

Figure 2:
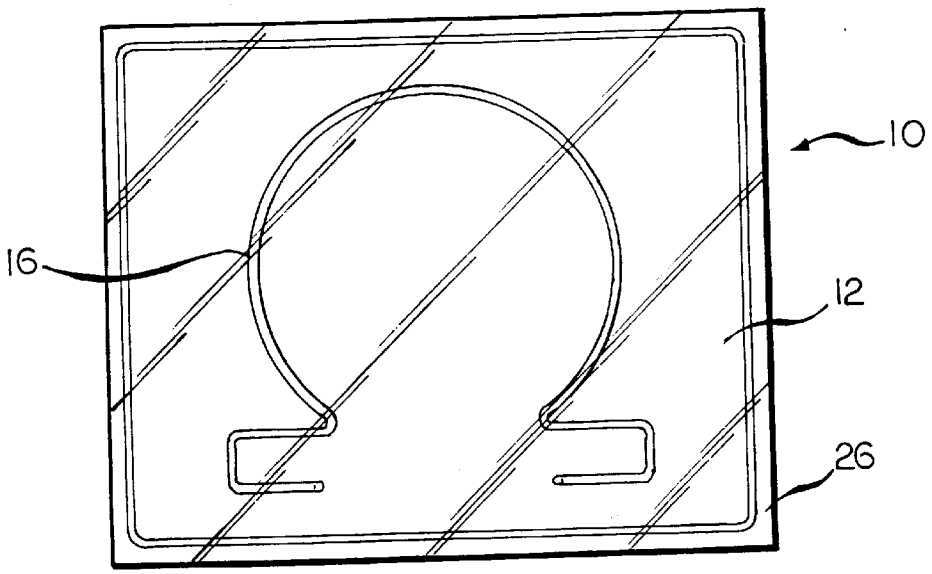
FIG. 2 is a front view of the display of FIG. 1.
Figure 3:
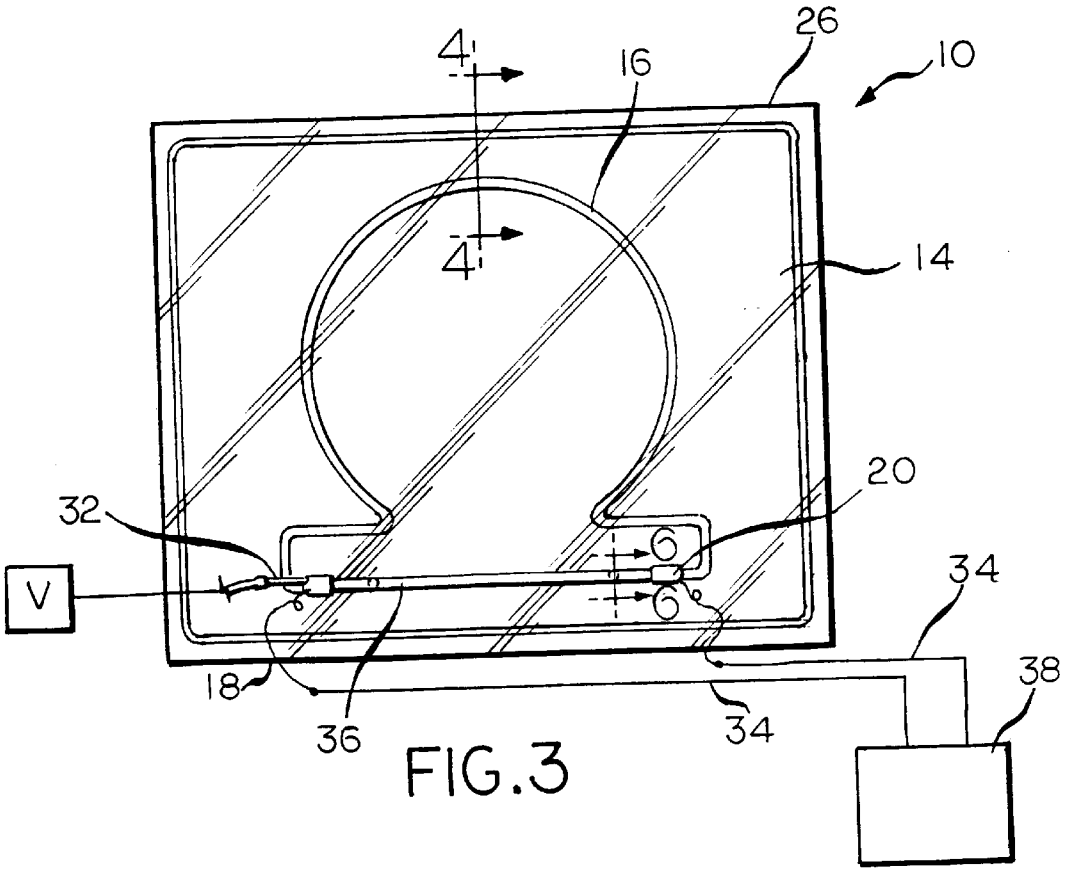
FIG. 3 is a rear view of the display of FIG. 1.

The channel 16 of the display 10 defines the gas discharge path and terminates at each end of the channel in an opening 22 in the back plate 14. It will be appreciated that the channel 16 may be of most any suitable configuration and length as desired. The channel 16 may be in the shape of a continuous tortuous path or in the shape of multiple independent paths configured to appear as a reference character such as letters or numbers. For illustrative purposes, the channel 16 is shown in FIGS. 1–3 in the shape of the greek letter "Ω". It will be appreciated that to facilitate the appearance of separate and distinct figures or characters, the display 10 may include an optional opaque masking layer (not shown) applied to one or more of the plates as well known in the art to mask the sections of the channel 16 interconnecting the figures or characters The channel 16 of the display 10 may be formed in the interior surface of one or more of the plate 12 and 14 by most any suitable means well known in the art including sand blasting or other mechanical means. In a preferred embodiment, the channel 16 is formed in one or more of the interior surfaces of the plates 12 and 14 by acid rotting. Acid rotting provides the ability to manufacture gas discharge displays 10 having narrow sharply defined channels 16 ranging in length up to the allowable limit specified by the manufacturer of the electrode, and of any width consonant with glass thickness. As the rotting of the channel produces an indentation in the glass, the limits of which will be inscribed within a semicircle, the maximum width of the channel is limited to the diameter of a semicircle having as its radius the thickness of the glass less the thickness of glass desired to be left after rotting.

Acid rotting involves preparation of a silk screen image employed to print a resist ink on the glass to protect those surfaces of the glass intended to be left unaltered by the acid. The resist-coated glass is submerged in a solution consisting substantially of hydrofluoric acid. In a preferred embodiment, the solution consists substantially of 48% hydrofluoric acid of a type commercially available from Allied-Signal Corp. The strength of the solution and its temperature interact to provide differing aesthetic and mechanical properties of the rotted area. After a time in the acid, which time is determined by the depth to which the glass is to be rotted, the glass plate is removed, and the rotting process is stopped by immersing the plate in a solution of caustic, typically a dilute sodium hydroxide. The plate is then rinsed thoroughly with water. From the final rinse, the plate is immersed in a solution of solvents (typically mineral spirits) to remove the resist ink. The plate, thus cleaned, is then further cleaned in an aggressive solution of water and ammonia in preparation for assembly into the current invention.

After the channel 16 is formed in one or more of the interior surfaces of the plates 12 and 14, a coating of light-emitting phosphor 24 is applied to the display 10 by most any suitable means determined by the depth of the rotted channel. For channels of less than about 0.06 inches deep, spray-deposition silk screening is most appropriate, as is the case in the preferred embodiment. Spray-deposition silk screen printing is a technique well known to the silk screening industry. For deeper channels, a selection is made between manually brushing the phosphor into the channel, (appropriate for low-volume production) and a technique known as "settling", accomplished by filling the channel with a suspension of phosphor and a vehicle such as denatured alcohol, and allowing evaporation to occur, during which the phosphor is deposited on the walls of the channel. The light-emitting phosphor 24 may be applied to the interior surface of the front panel 12, to the interior surface of the back panel 14, to the interior surface of the channel 16, or to the flat surface of the front panel or back panel when there is only one plate having a channel formed therein in use. The phosphor 24 changes the light color of the display 10 as required to improve the aesthetics of the display. The light-emitting phosphor 24 may be of most any suitable color and type as well known in the art.

Figure 4:
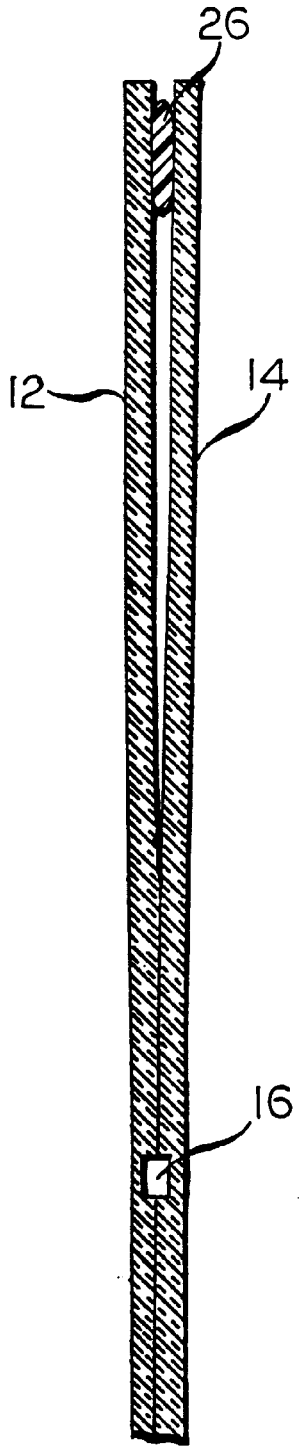
FIG. 4 is a partial cross-sectional view taken along line 4—4 of FIG. 3.
Figure 7:
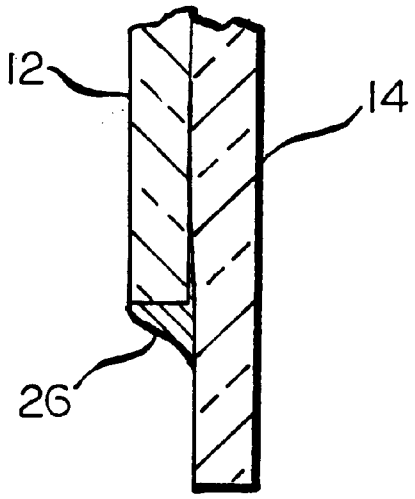
FIG. 7 is a partial enlarged cross-sectional view of overlapping sealed plates.

After the phosphor 24 is applied to the display 10, the two plates 12 and 14 are sealed together using a low temperature sealing media 26 of a type well known in the art such as Ferro Corporation Frit #7075 or Varian Corporation Torr Seal epoxy, or other suitable sealing medium. As shown in FIGS. 4 and 7, the sealing media may be placed between the two plates 12 and 14 or along the outer intersecting edge defined by the overlapping plates 12 and 14 and then drawn in between the plates during evacuation to effect a seal.

The low temperature sealing media 26 affects a seal about the perimeter of the display 10 without affecting the optical transparency of the plates 12 and 14. The sealing media 26 is placed about the entire outer perimeter of the display 10 to define an inner area circumscribing the channels 16 and an outer border area. In a preferred embodiment, the front plate 12 is hermetically sealed to the back plate 14 and aligned with the back plate so that any mirror image channels 16 formed in the respective plates match.

The electrodes 18 are positioned external of the plates 12 and 14 and in communication with the at least one channel 16. As shown in FIGS. 1, 3, 5 and 6, the electrodes 18 are positioned in communication through isolation tubes 28.

The isolation tubes 28 are sealed over the openings 22 formed through the back plate 14 of the luminous gas discharge display 10 by appropriate sealing media, such as, but not limited to, a low temperature glass sealing frit or low vacuum epoxy. The isolation tubes 28 function as a sealed passage connecting the electrodes 18 to opposing ends of the channel 16 at the outer surface of the back plate 14.

An electrode 18 is welded to the exposed end of each isolation tube 28. The electrodes 18 may be of most any type well known in the art and of a design to meet the operational requirements of the display 10. In a preferred embodiment, each electrode 18 includes an electrode housing 30 and an evacuation tube 32 formed integral with the electrode housing. An evacuation tube 32 formed integral with each electrode 18 provides easy access to the channel 16 and facilitates attachment of a device (not shown) to create a vacuum in the space between the panels 12 and 14 and provides access to the channel for back filling with a suitable inert gas prior to sealing, and access to the electrodes for supply of an electrical current through wires 34 leading from the electrode.

As shown in FIGS. 1 and 3, to improve the manufacture and quality of the display, a removable cross tube 36 is in communication with the interior of the isolation tubes 28 thereby temporarily interconnecting the isolation tubes. The cross tube 36 isolates heat and contamination from the channel 16 of the gas discharge display 10 during its manufacture. The cross tube 36 may be formed of most any suitable material, e.g., glass or plastic tubing and the like. In an alternate embodiment of the invention, the cross tube 36 may be formed of a metal or glass tube having a high vacuum flanged fitting at either end. It will be appreciated that the cross tube 36 must be designed so that the cross tube length is shorter and the physical resistance is lower than that of the channel 16. For example, as shown in the figures, the overall length of the cross tube 36 is less than the overall length of the channel 16 to provide less resistance.

After the display 10 is hermetically sealed a vacuum is drawn on the electrodes 18 through the evacuation tubes 32. The display 10 is evacuated by most any suitable method including mechanical or cryogenic pumping and the like. The vacuum allows external ambient air pressure to cause the two opposing plates 12 and 14 to deflect toward each other (FIG. 4), bringing the plates into intimate contact with one another thereby sealing and defining the channel 16 between the plates. The vacuum creates a condition of physical and dielectric resistance at all points of contact between the plates 12 and 14 and decreased resistance within the confines of the channel 16 so that the luminous gas discharge follows the contour of the channel as a path of least resistance. In addition, the optical and physical quality of the plates 12 and 14 is preserved because the plates are able to achieve a hermetic seal and never reach the softening temperature of the material forming the plates.

It will be appreciated that deformation of the plates 12 and 14 by vacuum and atmospheric pressure may be accomplished at a lower vacuum with thinner and longer spans of plates. It is found that this effect is successful in glass plates up to about 1.25 inches thick and about 30 inches in span. Moreover, in thicker glass, i.e., over about 0.125 inches thickness, the channels must not be formed closer than about 1.00 inch from the perimeter of the display, whereas in very thin glass sections, i.e., less than about 0.0625 inches thickness, the channel may be formed as close as about 0.125 inches from the perimeter of the display.

After the display 10 is hermetically sealed and a vacuum created in the display, the electrodes 18 are then prepared. The electrodes 18 are prepared by heating the electrodes to a high temperature under vacuum sufficient to remove a protective oxide film formed over the electrodes to decompose the compounds to provide the basic metal rich oxide which is the electrode surface. The typical metal rich oxide is barium oxide. The electrodes 18 are heated by applying an electric current between the electrodes. The temperature that the electrodes 18 must be heated to varies depending upon the type of electrode employed. For example, suitable electrodes 18 commercially available from Eurocom Corporation are heated to about 800° C. by applying high current for roughly two or three minutes to reduce the compounds to provide the metal rich oxide.

It will be appreciated that a feature of the process of the present invention is that the electric current applied between the electrodes 18 travels across the cross tube 36 connecting the electrodes as opposed to through the channel 16. Because of the position and size of the cross tube 36, the gas discharge between the electrodes 18 follows the path of least resistance, i.e., the path leading directly across the cross tube. Consequently, nearly all of the heat generated during the preparation of the electrodes 18 is quickly dissipated by radiation transfer along and through the vacuum and walls of the cross tube 36. The remainder of the heat generated during electrode preparation passes more slowly by conduction to the mass of plates 12 and 14 along the mass of the channel 16. Because of the arrangement of the isolation tube 28, cross tube 36 and position of the electrodes 18 external of the plates 12 and 14, the electrodes may be formed at a higher temperature, e.g. more than 850° C., without danger of causing a break in the seal in the display 10 or damaging the plates.

The length and orientation in space of the cross tube 36 and the isolation tubes 28 may be varied appropriately as a function of electrical power, gas mixture, gas discharge design, channel 16 length and channel volume. When the electrode 18 preparation temperature is reached and the electrodes are suitably prepared, the electric current supplied through the wires and the electrodes is reduced, and the temperature within the display 10 declines. The luminous gas discharge channel may then be "cleaned" at temperatures much lower than those typically used in electrode formation because, as previously described, the electrodes were prepared under vacuum at high temperature.

Figure 5:
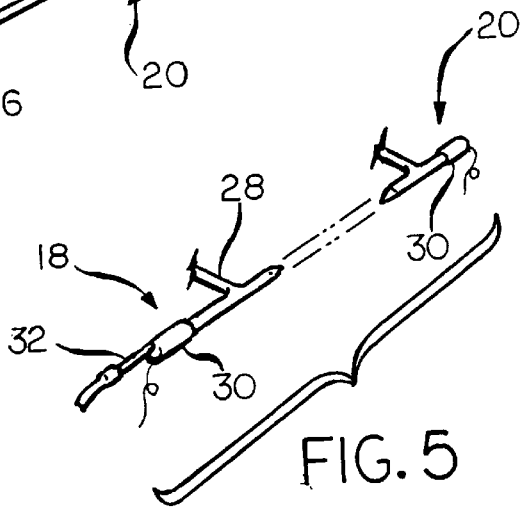
FIG. 5 is a partial view of the electrodes of FIG. 1 in accordance with the present invention.
Figure 6:
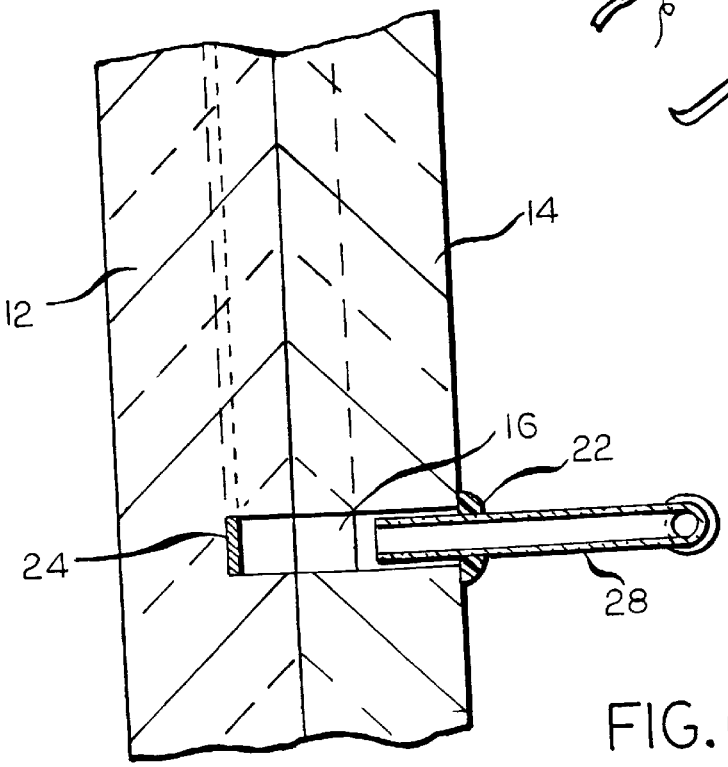
FIG. 6 is an enlarged partial cross-sectional view taken along line 6—6 of FIG. 3.

After the power to the electrodes 18 is reduced, the cross tube 36 is sealed off as shown in FIG. 5. If the cross tube 36 is entirely made of glass, the cross tube may be pinched off and removed from the display 10 as well known in the art. The display 10 is then back filled through evacuation tube 32 with an inert gas such as, but not limited to, neon, argon or xenon and the like. Because the cross tube 36 no longer connects the electrodes 18 and no longer functions as a possible path for the gas discharge, the gas discharge is now forced to travel from the electrode 18, down the isolation tube 28 and out the end of the isolation tube, through the channel 16 of the luminous discharge display, re-enter the opposing isolation tube 28 and return up the isolation tube to the opposing electrode 18.

Electricity to power the illumination display 10 is supplied to the electrodes 18 by way of wires 34 from a transformer 38 or the like of a type well known in the art.

Though the invention has been described and illustrated in connection with a luminous display 10, it is recognized that the invention may take other forms. For example, the invention may be back filled with xenon or argon gas and the like and supplied with light-emitting phosphors on the surface of the channel 16 to be used for general and commercial lighting, as a light source for photographic or x-ray viewing, or depending upon the thickness or size of the unit, for any general or specialized lighting requirement for which it may be appropriate.

The patents, patent applications and documents referred to herein are hereby incorporated by reference.

Having described presently preferred embodiments of the present invention it will be appreciated that it may be otherwise embodied within the scope of the appended claims.

What is claimed is:

1. A method of forming a luminous gas discharge display comprising the steps of:

providing a front plate and a back plate, at least the front plate of the display being formed of a transparent material;

forming at least one channel in an interior surface of at least one of said plates to define a gas discharge path, the at least one channel terminating at each end thereof in an opening in at least one of said plates;

applying a coating of light-emitting phosphor to the display;

sealing the front plate and the back plate in an opposing fixed position with the at least one channel being between the plates;

sealing an isolation tube over each opening;

welding an electrode including a housing and an evacuation tube to an exposed end of each isolation tube such that the isolation tube functions as a sealed passage connecting the electrodes to opposing ends of the at least one channel;

providing a removable cross tube in communication with the interior of the isolation tubes thereby temporarily interconnecting the isolation tubes;

hermetically sealing the display and then drawing a vacuum on the electrodes through the evacuation tubes;

preparing the electrodes by heating the electrodes to a temperature under vacuum sufficient to remove a protective oxide film formed over the electrodes; and then sealing off the cross tubes and then backfilling the at least one channel through the evacuation tube with an inert gas.

2. The method of claim 1 wherein the electrodes are prepared by applying an electric current between the electrodes.

3. The method of claim 2 wherein the front plate and the back plate are sealed by a sealing media placed about the entire outer perimeter of the display to define an inner area circumscribing the at least one channel.

4. The method of claim 1 wherein the at least one channel is formed by acid rotting.

5. The method of claim 4 wherein the light-emitting phosphor is applied by spray-deposition silk screening.

6. The method of claim 4 wherein the light-emitting phosphor is applied by brushing the phosphor into the at least one channel.

7. The method of claim 1 wherein the step of drawing a vacuum through the evacuation tubes allows external ambient air pressure to cause the two opposing plates to deflect toward each other thereby bringing the plates into intimate contact with one another to seal the at least one channel between the plates.

8. The method of claim 7 wherein the electrodes are prepared by applying an electric current between the electrodes.

9. The method of claim 7 wherein the light-emitting phosphor is applied by spray-deposition silk screening.

10. The method of claim 7 wherein the light-emitting phosphor is applied by brushing the phosphor into the at least one channel.

11. The method of claim 7 wherein the at least one channel is formed by acid rotting.

* * * * *